US009522404B2

(12) United States Patent
Stehli, Jr. et al.

(10) Patent No.: US 9,522,404 B2
(45) Date of Patent: Dec. 20, 2016

(54) FLOWABLE DISPENSERS, SYSTEMS, AND FILLING PROCESSES

(76) Inventors: Charles Stehli, Jr., Maple Glen, PA (US); Donald Pansier, Green Bay, WI (US); Robert DeMatteis, Grass Valley, CA (US)

( * ) Notice: Subject to any disclaimer, the term of this patent is extended or adjusted under 35 U.S.C. 154(b) by 0 days.

(21) Appl. No.: 14/236,146

(22) PCT Filed: Jul. 7, 2012

(86) PCT No.: PCT/US2012/045872
§ 371 (c)(1),
(2), (4) Date: Jan. 30, 2014

(87) PCT Pub. No.: WO2013/019362
PCT Pub. Date: Feb. 7, 2013

(65) Prior Publication Data

US 2014/0166699 A1 Jun. 19, 2014

Related U.S. Application Data

(60) Provisional application No. 61/574,392, filed on Aug. 1, 2011.

(51) Int. Cl.

| | |
|---|---|
| ***B65D 35/28*** | (2006.01) |
| ***B05B 11/00*** | (2006.01) |
| ***B65D 83/00*** | (2006.01) |

(52) U.S. Cl.
CPC ..... *B05B 11/0054* (2013.01); *B65D 83/0055* (2013.01)

(58) Field of Classification Search
CPC ..... B05B 11/0045; B05B 11/0054; B65D 83/0055; B65D 83/0061; B65D 83/0066; B65D 83/0094; B65D 2231/001
USPC ..... 222/1, 105, 209, 420–422, 541.9, 632,222/81, 82, 95
See application file for complete search history.

(56) References Cited

U.S. PATENT DOCUMENTS

| | | | | |
|---|---|---|---|---|
| 5,005,733 A * | 4/1991 | Stoody | ..... | 222/105 |
| 5,111,971 A * | 5/1992 | Winer | ..... | 222/95 |
| 5,333,758 A * | 8/1994 | Jamison | ..... | B65D 75/5811 222/101 |

FOREIGN PATENT DOCUMENTS

| | | | | |
|---|---|---|---|---|
| JP | 2006-111335 | * | 4/2006 | ..... B65D 1/02 |

* cited by examiner

*Primary Examiner* — Frederick C Nicolas
*Assistant Examiner* — Bob Zadeh
(74) *Attorney, Agent, or Firm* — Advantage IP Law Firm

(57) ABSTRACT

Systems and methods are disclosed for a dispensing system with a disposable liner including a bag; a nozzle positioned at a first end of the bag; and an openable portion on the nozzle, wherein the bag and nozzle are adapted to be inserted into a dispenser.

16 Claims, 8 Drawing Sheets

FIG. 8
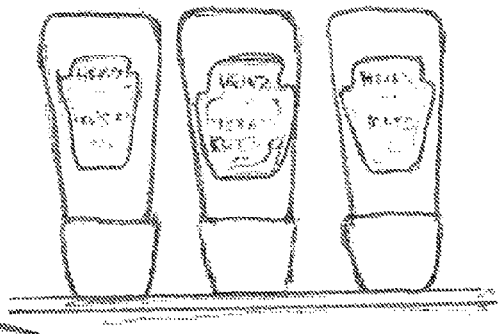
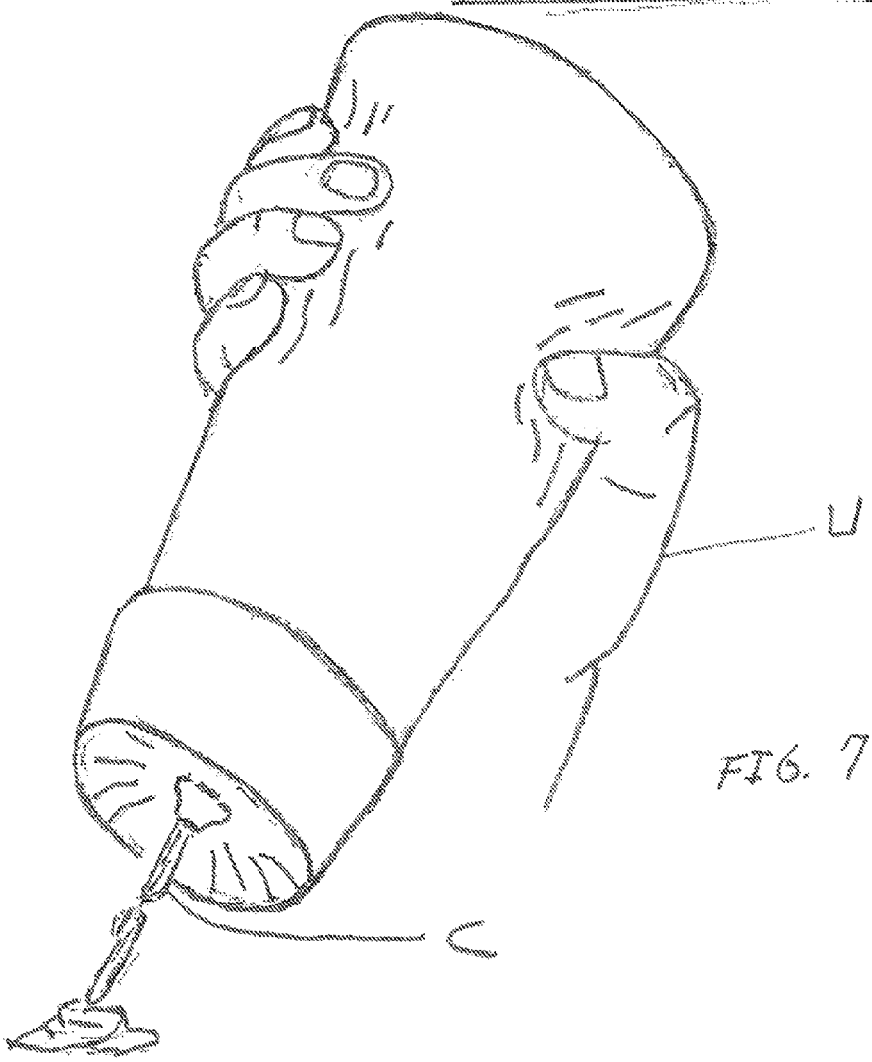
FIG. 7

FLOWABLE DISPENSERS, SYSTEMS, AND FILLING PROCESSES

CROSS-REFERENCE TO RELATED APPLICATIONS

This application is a U.S. National Stage application of International Application No. PCT/US2012/045872, filed on Jul. 7, 2012, which claims the benefit of Provisional Application Ser. No. 61/574,392 filed on Aug. 1, 2011, which are hereby incorporated by reference in their entireties.

BACKGROUND OF THE INVENTION

The system relates generally to bottle dispensers such as those used to dispense fluids and sauces an other flowable contents, and more specifically it relates to a dispenser and system that is efficacious for use in higher volume applications, such as restaurants or certain industrial uses, and is also adaptable to medium- and high-volume filling operations.

DESCRIPTION OF RELATED ART

Squeeze bottle dispensers are commonly used to dispense sauces such as mustard, ketchup, dressings, and the like. One of the most common sauce dispensers is one in which most consumers are very familiar, the common squeezable, plastic mustard bottle, such as the one used by French's® mustard. Its use is easy to understand and easy to use by simply removing the cap, turning it upside down, squeezing the plastic bottle and dispensing the sauce from a pointed tip (nozzle), in the cap. After use it is stored in an upright position. One of the primary problems associated with the use of this traditional plastic squeeze bottle is waste, as it is difficult to extract the last remaining contents. It is an inconvenience when trying to dispense the remaining contents from the squeeze bottle as users have to turn the bottle upside down and shake it or bang it on a countertop several times in order to extract the remaining sauce. Another problem with this type of bottle is that it is not easy to refill and is instead thrown away, contributing substantially to the waste stream.

Dispensers used in restaurants and higher volume fast food chains have partially addressed the problems associated with the ordinary plastic squeeze bottle. One of the more popular brands is Tablecraft®. These restaurant bottles tend to be larger, cylindrical and more recently, some are dispensed and stored in an inverted disposition. The inverted bottles are able to dispense liquid sauces by using specialty valves that are more or less, leak-resistant. In other words, the sauce will dispense when the bottle is squeezed, but the sauce does not leak out when the squeezing pressure is released and when the bottle is stored in an inverted disposition. The primary benefits of the inverted bottle to restaurants is that users can quickly grasp and dispense sauces without turning the bottle upside down, and perhaps more important, the contents are always ready for dispensing since they will settle in the bottom of the bottle where the special leak-resistant dispensing valve (nozzle) is located. Examples of this type of dispenser is the FIFO® bottom dispensing bottle and the more recently the single-use bottle used by H.J. Heinz® for its ketchup, which is sold in the supermarket retail trade. Another benefit of a bottom dispensing bottle for the food service trade is that it can be refilled, helping to reduce the trash stream compared to single-use bottles. However, the use of these dispensers have created new problems, most importantly ones associated with sanitation, productivity and waste.

While it may be advantageous to refill the inverted bottle, as is the case in most high-volume fast food restaurants, the bottle must be washed out thoroughly in between uses to prevent the build up of bacteria and contamination. Likewise, the large bulk containers create new environmental concerns since they also contribute to the trash stream and if the contents are not properly stored and handled, they can become contaminated as well. Washing and refilling the inverted bottles is a time consuming, and at times tedious task, when attempting to remove all of the caked-on sauces that may accumulate on the bottle and in the valve.

Various attempts have been made over the years to produce a dispenser that can evacuate all the contents, beginning with U.S. Pat. No. 2,608,320 Harrison. His invention provides a pump type of dispenser that employs an air pressure system for ejecting a material (substance) inside renewal cartridges that has a movable member bonded to a rigid member. Its intended use was for products such as shaving cream and toothpaste. Methods to manufacture this type of cartridge today would be cost prohibitive, let alone in 1953. This especially true if used in a high-volume restaurant application such as fast food restaurants.

Another attempt is illustrated in U.S. Pat. No. 5,305,920 Reiboldt, et. al. In the '920 patent, it utilizes a relatively complex support tube (sometimes called a birdcage) that is attached to a lid component, inserted inside a bag filled with fluid contents, and which lid/birdcage is secured to a squeezable bottle. Typically the lid serves as a dispensing fitment, such as may be used for toothpaste or other viscous materials. The approach has merit as it may use reusable bags for its contents, however, cleaning the birdcage/lid/fitment combination presents a challenging proposition if it were to be used in a high volume application, plus the cost of the combination unit would be costly based on today's standards. In the present day high-volume sauce dispensing industry it would be inconceivable such an expensive, difficult to wash dispenser would be used. It is more suitable for single-use retail applications.

In U.S. Pat. No. 6,305,577, Fillmore uses a narrow necked pouch and hanger to accomplish a similar result for viscous fluids. The '577 invention uses a rather sophisticated [rigid] hanger/pouch assembly with a flexible bag (to be filled with viscous contents) bonded to the hanger. The result is substantially the same as the '920 or '320 patent in that an inversion of the flexible bag will take place. Like the '920 and '320 patents, its cost and limitation of use is also restricted to low-volume or single-use, retail applications.

In addition to the '320, '920 and '577 patented inventions, "a bag in a box" has been commonly used in an effort to lower costs, reduce the environmental impact, and help reduce waste. These applications typically consist of dispensing milk, wine and various sauces and effectively use gravity to assist in the evacuation of the contents. They would of course, be ineffective if used in smaller hand held dispensers (bottle and the like) such as sauces used in food service.

Other than the inverted dispensing bottle, all of the prior art inventions are impractical for high-volume use in restaurants and in particular, fast food chains. The expense of the dispensers and the various hangers, birdcage/cap assemblies, pistons and so on, are prohibitive for high-volume, low cost, restaurant chains. The use of bags in boxes or other form of container is also impractical if used in a hand held application. The cleaning of the various elements and components is difficult, reuse is cumbersome at best, and the cost for the complex bag configurations with its multitude of fitments is too costly for high volume use. While the use of the inverted refillable dispenser may be desirable in restaurants, serious questions have been raised regarding the critical need to thoroughly wash the dispensers various parts between uses to prevent bacteria and contamination, the productivity problems associated with washing and refilling, and the questionable environmental qualities of the bulk containers. Likewise, continual transfilling of contents adds to the vulnerability of potentially serious contamination.

The use of a low-cost dispenser and sauce refill system that can overcome the numerous problems associated with prior art would be valuable to the restaurant trade and many others. Not one of the prior art products or patents is suitable for, or can be adapted or modified to accomplish, the dispensing of fluids and liquids as desired by the preferred embodiment. This coupled with an efficacious method of pre-filling an internal liner and likewise reduce waste would be highly desirable for high-volume, high productivity uses, such as restaurants and the like.

BRIEF SUMMARY OF THE INVENTION

Systems and methods are disclosed for a dispensing system with an elongated dispenser bottle having a squeezable mid-section, a dispensing cap, pump or sprayer with a nozzle; and a pre-filled liner adapted to be inserted into the bottle, wherein the pre-filled liner includes viscous materials therein for delivery when the bottle is squeezed on or below the squeezable mid-section.

Advantages of the system may include one or more of the following. The dispenser, liner, and system of the preferred embodiment overcome the problems associated with prior art. There is also the added benefit of being able to be cost-effectively filled using present day production processes, which is not possible with prior art. Also of importance is that the preferred embodiment overcomes the need to wash and refill the dispensers and eliminates the sanitation problems associated with storing open bulk containers of sauces and fluids. The preferred embodiment is an invertible liner (or cartridge as it may appear when filled and lidded) that can be effectively squeezed at the most desirable location, the lower middle portion of the bottle, and provides the desired rigidity and yet flexibility in use. Other major advantages of the preferred embodiment are that that it substantially reduces waste, its use is intuitive to any restaurant employee, and requires virtually no training. These advantages alone can save a restaurant chain hundreds of thousands, even millions, of dollars a year. The simplicity of the design of the preferred embodiment includes a low cost dispenser squeezable bottle (inverted or right side up), a liner and a nozzle, all of which are disposable . . . which is in sharp contrast to prior art. The liner (again, may be referred to as a bag, body, cartridge, pouch and the like) is also exceptionally low cost in comparison to prior art. All components may be made with the most cost-effective, state of the art means used in industry today, thus the cost is far lower. Obviously the cost of a pre-filled, disposable liner/nozzle is substantially less than the cost of a pre-filled squeeze bottle, thus also represents a substantial savings to restaurants. The cost of the disposable liner/nozzle of the preferred embodiment compared to all the prior art patented inventions is from 30% to 80% less.

The unique design of the liner and the nozzle are perfectly matched, which maximizes evacuation of the contents, reduces waste and improves productivity. The liner is optimized for shipping and handling after its filled. Unlike prior art, there is no expensive container or outer shells to attach to the liner, and in some cases no need to attach nozzle (as a fitment) to the liner, as the liner may have its own self-contained nozzle as an inherent part of its design. Since the liner of the preferred embodiment is disposable and not affixed to the dispenser no cleaning is required of the dispenser or its fitments. Only an occasional washing of the dispenser may be required as outside contaminants may build up over time. The disposable liner/nozzle of the preferred embodiment may be manufactured as a single component or at times may be two separate units. In other words, they may be made in two components, a disposable liner and a disposable nozzle, whereas the liner is punctured by the disposable nozzle prior to being put into use. In either case the dispensing is essentially the same.

The liner/nozzle of the preferred embodiment may be manufactured in a form, fill and seal operation, horizontal sealing system, and at times with thermoforming or a bottom seal bag making operation. The size and shape conforms to the inner contour of the outer dispenser bottle (container), and the contents are evacuated with minimal waste. The unique liner/nozzle combination may be configured in a number of ways, but the filling with flowable contents, sauces, and the like, may be performed on traditional filling lines with some modifications.

Unlike prior art, the liner/nozzle may be made with food-related barrier properties to increase shelf life, yet still remain soft and flexible enough to dispense effectively so that waste is minimized.

Also unlike other prior art products the raw material composition and design of the nozzle is such that it is rigid enough to support dispensing from the liner itself, and yet is designed with an ease of opening in order to put rapidly into use. This is important as users will need to understand how to use the preferred embodiment without substantial training aids. In most applications, the use of the preferred embodiment is easy enough that it follows the "monkey see—monkey do" principle. In other words, watching a user employ the preferred embodiment once is enough for the next person to know how to use it.

Furthermore, unlike the complicated prior art systems with their components, fitments, welds, attachments, and so on, the pre-filled liners in the system of the preferred embodiment can be easily, quickly loaded into the bottle dispenser. The liner/nozzle naturally seats itself in the dispenser bottle and requires no bonding or other attachment to the dispenser bottle as required with prior art. The user simply inserts the liner/nozzle into the dispenser bottle, opens the nozzle, and starts squeezing.

The squeeze bottle used in the preferred embodiment is also unlike the prior art systems in that it is a simple design with few components and its use is similar to the standard squeeze bottles currently used at home an in industry. The bottle only requires one opening on one end, unlike the complicated systems requiring top and bottom access and/or caps. The unique simplistic cap design provides a secure airtight environment inside the dispenser bottle and is easy for users to use. This is typically by use of a duckbill valve or a gasket type of seating method.

The nozzle in the preferred embodiment prevents leakage and reduces waste and likewise prevents air, gases and bacteria from entering the contents inside the liner. The liner/nozzle may be stored in any environment suitable to maintain proper sanitation for the type of flowable contents contained.

Since the liners of the preferred embodiment are pre-filled, the common problem of the contents coming into contact and leaching onto the interior of a squeeze bottle is eliminated, thus preventing cross contamination from a previously used bottle dispenser. This also prevents discoloration of the squeeze bottle since there is no contact with the contents. This substantially increases the life of the squeeze bottle, which may in turn be used for different types of sauces without being tainted by discoloration. Then again, once the sauce has been completely used, instead of tediously washing the dispenser bottle after use, a new pre-filled liner is slipped into place instead.

The disposable liners of the preferred embodiment completely eliminate the unsanitary task of trans-filling and funneling products from large bulk sauce bags or cans into the traditional squeeze bottle. Its use likewise completely eliminates the common problem of "topping off" when filling prior art squeeze bottles, which may harbor bacteria in the residue in the bottle from prior use. Topping off is a big problem in the restaurant trade as the residue and fugitive particles from prior use frequently remain in the bottom of the squeeze bottle leaving a breeding ground for bacteria and an unsanitary environment.

The dispenser bottle of the preferred embodiment may use a combination of a one way umbrella valve to allow air to enter the bottle but not escape, and a one way duckbill valve which closes tightly after dispensing a fluid. Both prevent air or gases from reaching the contents and maintain the contents in a sanitary airtight environment, thus, preserving freshness and increasing shelf life. Unlike other prior art the filled dispenser bottle and liner/inversion tube system of the preferred embodiment can be used and stored both upside down or right side up, depending on the users preference.

Another substantial benefit of the preferred embodiment is that it is able to dispense a wide variety of products including thick viscous products, thin products, and even fluids that contain heavy particulates. If preferred a choice of a variety of nozzle widths can also be used with various geometries and durometers to dispense various products. If needed, a dome valve or something similar may be used in combination with the duckbill valve to take pressure off of the head of the duckbill valve and prevent thin fluids, such as vinegar, from leaking when stored upside down for long periods.

Because the dispensing system is pressurized and holds the contents in an airtight environment (vacuum), the contents are always ready to be instantly dispensed with a gentle squeeze, regardless of whether the bottle has been stored right side up or upside down. Unlike the traditional squeeze bottles, this system does not require banging or shaking and doesn't spit or burp during dispensing. The pressurized system reduces waste and increases overall productivity and performance.

The preferred embodiment may at times also be used with a pump or spray bottle cap as disclosed in our pending patent application entitled Lidding, Pull-tab, and Self-opening System (LPTSO), instead of with a disposable nozzle. In such a case, the nozzle serves as an exit port for the liner, connected to the pump or spray head, in which the contents in the liner are dispensed. The same pressurized technology will suspend the fluid contents in a vacuum and reduce waste and dispense with ease. With the spray application the dispenser bottle of the preferred embodiment is able to spray 360 degrees while holding it at any angle including upside down. Since the flowable contents being sprayed is always at the top next to the exit port (nozzle) it does not spit or misfire. Likewise with a pump, it may swivel about the cap and pump its contents upside down or right side up.

The objectives of the preferred embodiment are to provide:

1) A low cost flowable contents dispenser;
2) A dispenser system that dispenses substantially all of its contents;
3) A dispenser that does not require refilling;
4) A cost effective liner and nozzle system;
5) A dispensing system that uses sanitary prefilled liners;
6) A pre-filled liner that collapses upon the application of pressure;
7) A pre-filled liner and nozzle that can be squeezed inside a dispenser.
8) A dispensing system that maintain the internal cleanliness and sanitation of the dispenser bottle;
9) A liner with a disposable nozzle that may be prefilled prior to use;
10) A liner and nozzle that may be discarded after use;
11) A method of using pre-filled liners that requires little or no training;
12) A dispensing system that may be used right side up or upside down without the contents settling;
13) A spray bottle dispenser system that adapts to the nozzle of the preferred embodiment;
14) A pump-style dispenser system that adapts to the nozzle of the preferred embodiment.
15) A process of pre-filling the liner of the preferred embodiment.

Furthermore, it is an object of this application to illustrate the preferred embodiments and broadly state the methodologies that may be used in order to describe the primary objective being accomplished.

BRIEF DESCRIPTION OF THE DRAWINGS

FIG. 7 is a perspective view the liner/nozzle of the preferred embodiment and its dispenser system placed in use.

FIG. 8 is a front view illustrating the dispenser system of the preferred embodiment stored in an inverted disposition.

DETAILED DESCRIPTION

A. Description of the Preferred Embodiment

Figure 1:
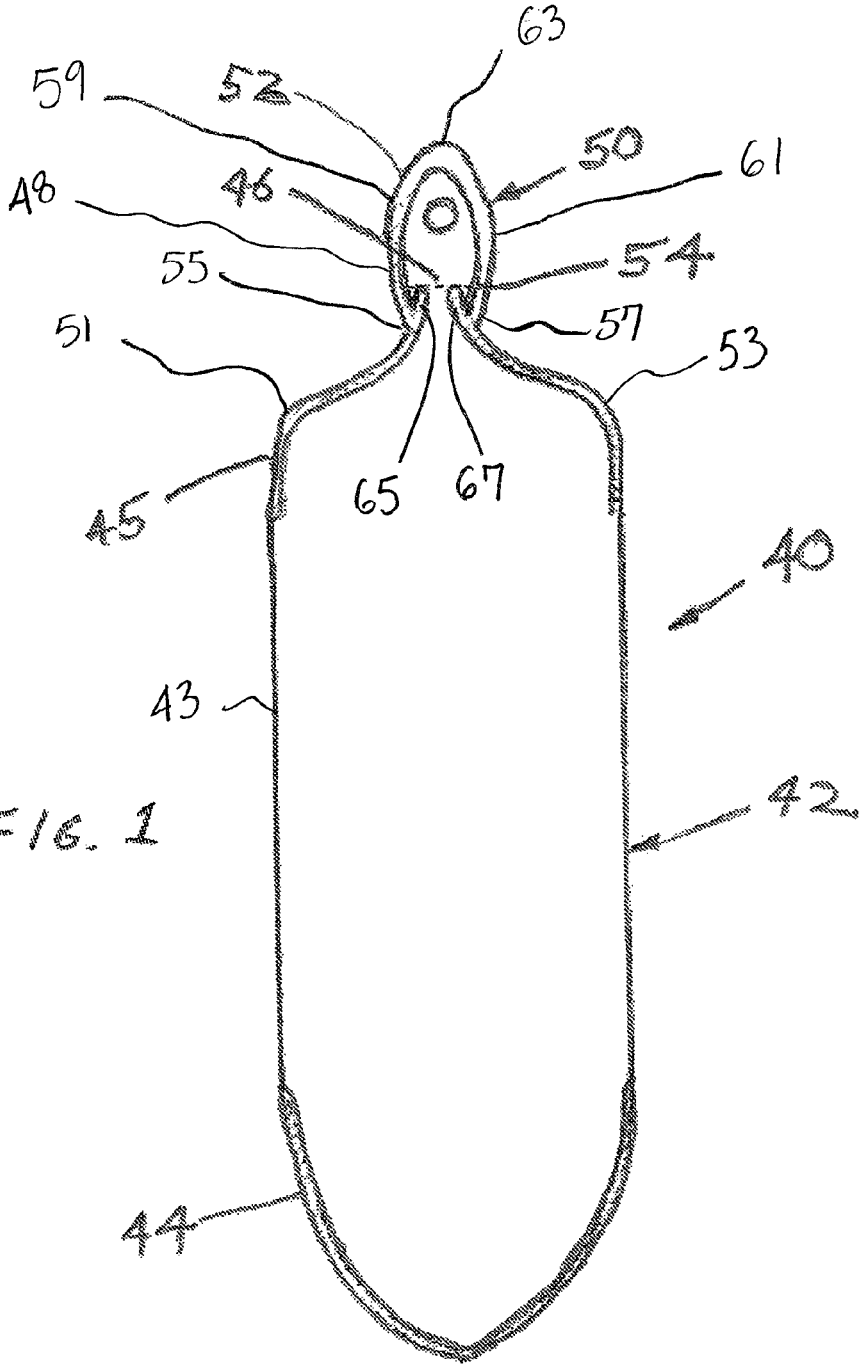
FIG. 1 is a perspective view of the preferred embodiment illustrating the components that make up one of the preferred versions.

In FIGS. 1 through 5, the dispenser system of the preferred embodiment 10 consists of a dispenser bottle 20, a dispensing cap 30, a pre-filled liner 40, with a disposable nozzle 50. Dispenser bottle 20 has a body 22, a one-way umbrella valve 24 and open end 26. Cap 30 has a force fit attachment means 32 (it may also be a standard screw on cap or other form of means of attachment to a bottle's base), a seating means 34 (this may be in the form of a form-fit gasket as illustrated or may be a self-closing valve such as a duckbill, such constructions being inherently flexible, resilient, and compressible to capture or seat a portion of the flexible open end of the liner and suspend the liner from the cap). Pre-filled liner 40 has a liner body 42 where a volume of contents C (FIGS. 7 and 9) are received or contained; the liner body including a sidewall 43, a closed end 44 (defined by a sealed line), a closed top 45 (defined by a sealed line 54), an open end 46 flanked by a pair of inwardly tapered extensions 65, 67 of the liner body 42, which is provided in an upper portion 48 which extends from a pair of opposing left and right shoulders 51 and 53, respectively as shown in FIG. 1. The shoulders 51, 53 transition inwardly toward one another and then curve upwardly to meet the nozzle 50 in a region of opposing left and right inflection points 55, 57, respectively. Nozzle 50 covers the open end 46 of the liner body 42 and has a pair of left side and right side outwardly flaring sections 59, 61, respectively that curve outwardly from the respective left and right inflection points 55, 57, and then inwardly to form a rounded tip 63 or leading edge to facilitate penetration through an opening 31 (FIGS. 4, 6) in the cap 30. The nozzle 50 includes an upper openable pull tab 52 and a separation means 54, as illustrated in the form of a scored line, which when pull tab 52 is detached, removes the nozzle 50 and exposes the open end 46 on liner 40 through which the contents C (FIGS. 7, 9) of the liner 40 may flow. When a one-way duckbill valve is used as the seating means, it allows contents to dispense out of the liner, but shuts off afterward preventing air from entering inside the liner. If a duckbill valve is used, then nozzle 50 would be elongated sufficiently to fit through the added length of the duckbill valve. A suitable separation means may be a scored line, or partially perforated line as the case may be, and may have a pre-weakened notch on its outer edge to help propagate a lateral tear. As will be illustrated in FIG. 6, the lateral tear opens the end of the disposable nozzle prior to dispensing. Nozzle 50 may be formed as an inherent part of liner 40, or as will be illustrated in FIG. 10, nozzle 50 may also be in the form of a fitment to reinforce the opening 46, which provides substantially the same results by substantially the same means.

Figure 3:
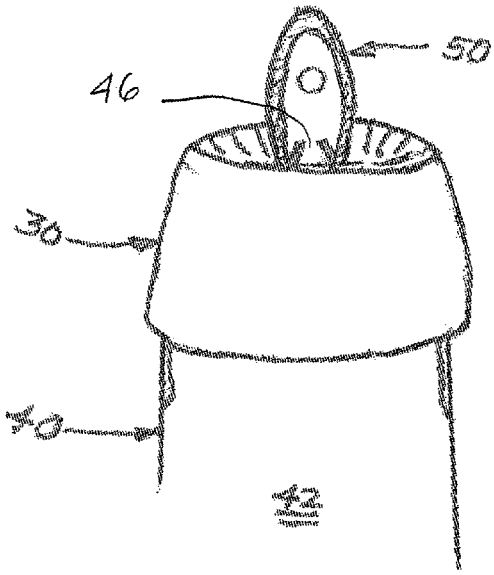
FIG. 3 is a perspective view of the preferred embodiment in FIG. 1 with its nozzle inserted into a cap on a dispenser.
Figure 2:
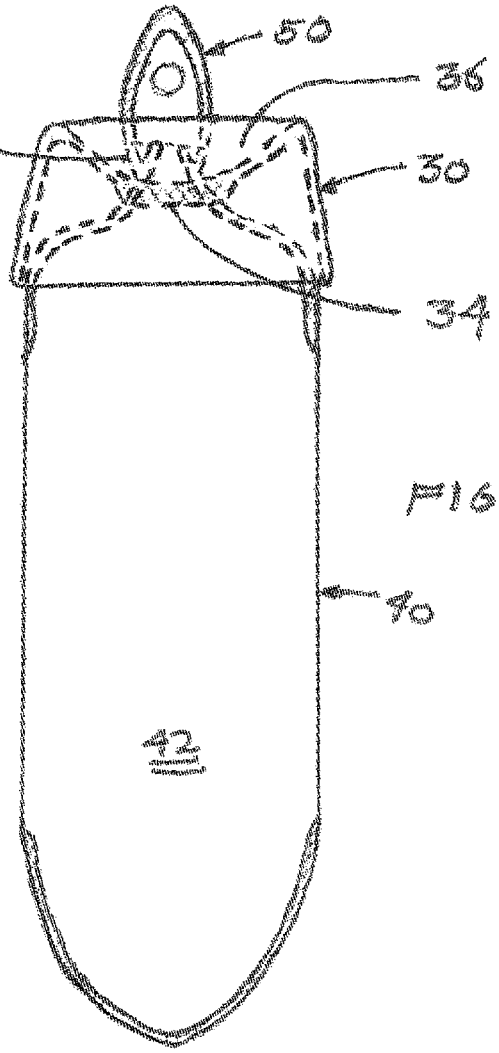
FIG. 2 is a phantom view of the preferred embodiment in FIG. 1 with its nozzle inserted into a cap on a dispenser.
Figure 4:
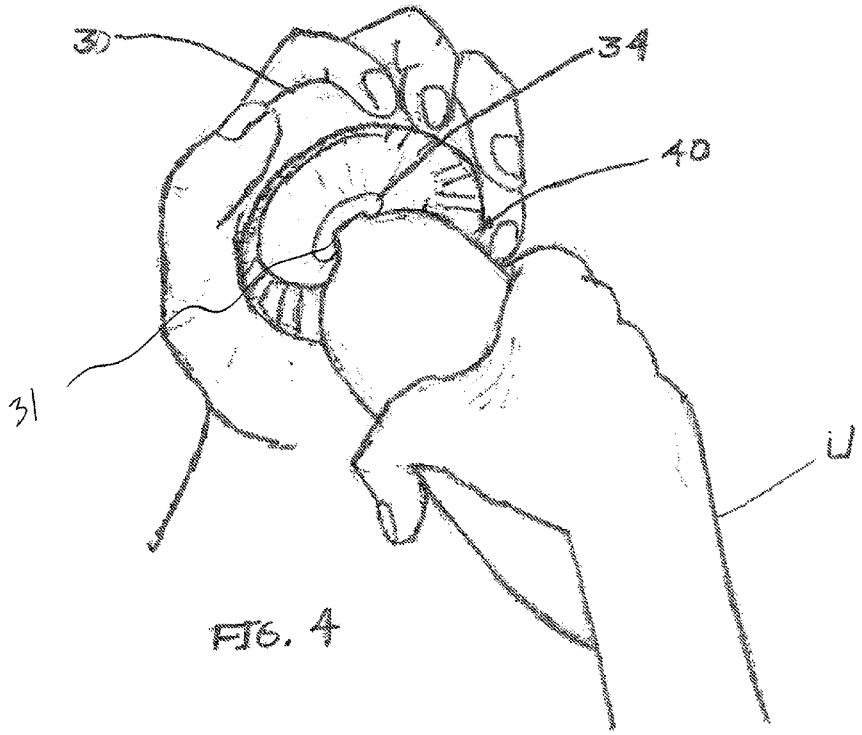
FIG. 4 illustrates one method in which the preferred embodiment may be inserted into a dispenser bottle.

Bottle 20 of dispenser system 10 is typically made of a squeezable material much like that of traditional squeeze bottles used today to dispense contents such as tomato sauce or mustard, or may be a bottle such as the Tablecraft bottle, model #124 (with the addition of a one-way valve). It has a single open end 26, which receives cap 30. As illustrated in FIGS. 2, 3, and 4, after inserting disposable, pre-filled liner 40 into cap 30, the combination is then inserted into bottle 20 (illustrated in FIG. 5), which forms an airtight environment. The cap may be a snap on cap, a threaded cap, or a combination snap on and twist and turn (such as a quarter arc), and so on. The importance here is that with liner 40 and its nozzle 50 secured in place inside bottle 20 and at least partially through an opening 31 (FIGS. 4, 6) in the cap 30, the internal air inside bottle 20 will not escape. This secure closure helps maintain the pressurized bottle and dispenser of the preferred embodiment.

The one-way umbrella valve at the end of bottle 20 serves two essential functions. First, after dispenser bottle 20 is squeezed and contents are dispensed, one-way umbrella valve 24 allows air to enter the bottle, thus neutralizing space S between liner 40 and the inside of bottle body 22, which in turn causes the contents inside liner 40 to remain, more or less, in a vacuum state, (see FIG. 5). Once the user stops squeezing the bottle, the internal pressure ceases and dispensing (or evacuation) of contents also ceases. Second, umbrella valve 24 serves as a check valve and prevents outside contaminates from entering when dispenser 10 is being stored. The preferred embodiment is not limited to the use of an umbrella valve 24 as illustrated, as there are other forms of valves, such as a duckbill, butterfly, and so on, may provide essentially the same results. The size of this valve may be determined based on the application, the size of the bottle, the amount of desired pressure to maintain internally and so on. The location may be in anywhere on the bottle, but ideally it is in a location that is not an obstruction for the user.

Cap 30 of the preferred embodiment is typically a molded plastic piece that has a centrally located, flexible seating means (gasket, duckbill valve, and so on) 34. Being a one-way valve, it allows for contents, fluids, sauces, and the like, to evacuate, in other words, to be dispensed from dispenser 10. When bottle 20 is squeezed it in turn squeezes liner 40, dispensing contents from open end (See FIG. 7). The purpose of the convex shape 36 of cap 30 is to allow dispenser 10 to be stored in an inverted (upside down) position for a faster dispensing without allowing open end of the nozzle's open end 56 to touch a counter top (see FIG. 8).

Figures 5, 6:
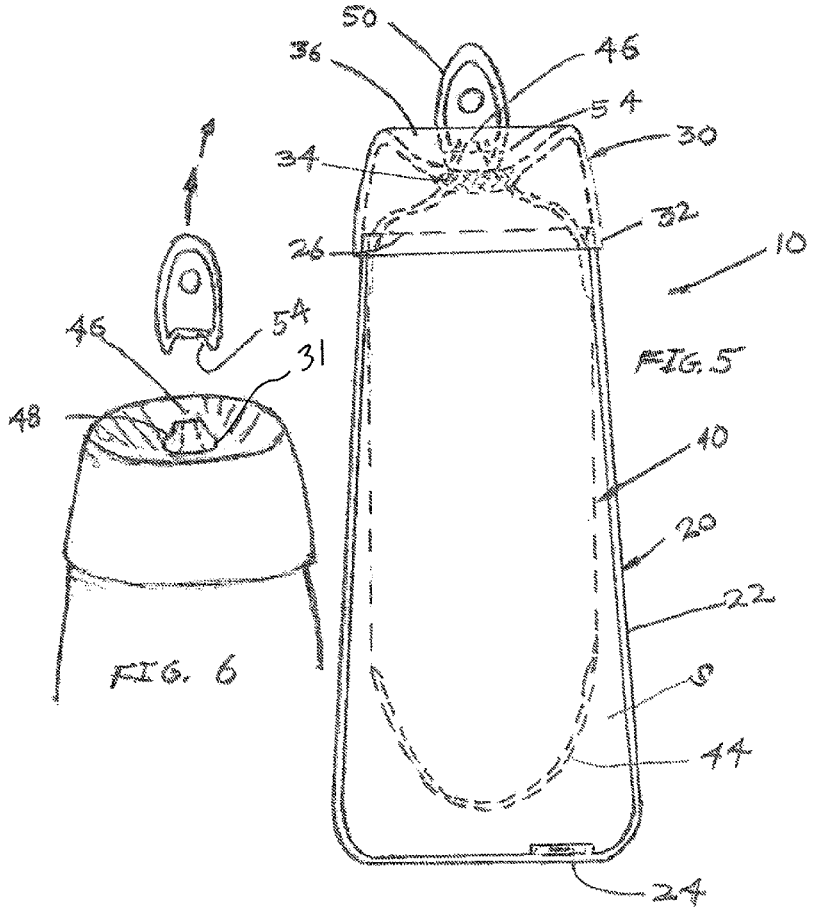
FIG. 5 is a phantom view the preferred embodiment after the dispenser base has been attached to the dispenser cap.
FIG. 6 is a perspective view illustrating one way of opening the nozzle of the preferred embodiment.

As illustrated in FIGS. 5, 6, 7, 8 and 9, liner 40 has been inserted inside dispenser bottle 20 and retained in place by securing means 32. FIG. 6 illustrates the opening of nozzle 50 by pulling up (or sideways as the case may be) on nozzle 50 using the pull tab causing the separable nozzle component 52 to be removed at tear line 54. This removable portion 52 exposes the open end 46 of the liner 40 and the contents C (FIGS. 7, 9) are now ready to be dispensed, either upside down or right side up. The upper portion 48 of liner 40 proximate the opening 46 is sufficiently widened, or "shouldered" near the inflection points 55, 57 as the case may be, in order to remain seated in seating means 34 (see FIG. 6). This works equally well with a seating gasket or duck bill valve. At times the upper portion may not be shouldered as other means of retention may be used, such as a force fit, or the use of a strong self-closing seating means that maintains a firm clamp onto upper portion 48. The unique simplicity of the design and structure make its use instinctive, exceptionally easy. Everyone knows how to remove a pull tab. Regardless of the type of contents, fluid or sauce, the material used to construct liner 40 is typically a form of plastic material, a single layer, co-extruded film, or laminated film that may be modified in any number of configurations to fit the dispensing system. As is understood in the trade, some contents may require certain film barrier properties that others do not. For example, sauces such as ketchup will require barrier properties much different than ordinary water.

In FIG. 5 liner 40 has been inserted into bottle 20, substantially filling the inside space S in bottle base 42. As illustrated liner 40 is tapered at its closed end 44, which tends to improve the evacuation of contents as liner 40 is dispensed (see FIG. 9). The unique combination of liner 40 and nozzle 50 represents a significant reduction in the trash stream compared to discarding entire bottles.

As illustrated, liner 40 and nozzle 50 may be made of a multitude of plastics and combinations, shapes and styles. The method of forming liner 40 may be form, fill, and seal (FFS), horizontal forming and filling systems, or at times, may be a modified bottom seal bag machines. The type of process to manufacture liner 40 is not restricted to a specific type as long as it provides the desired outcome. Nor is the combination of forming nozzle 50 or applying a fitment in its place, which likewise may be done in a multitude of ways.

B. Method of Use

In FIGS. 3, 4, 5, 6, 7, and 9, a user U has grasped liner 40 of the preferred embodiment and inserts the intact nozzle 50 and nozzle opening 46 though the opening 31 in the cap 30 (FIG. 4) seating the outwardly flared sections 59, 61 above the inflection points 55, 57 on the seating means 34 with the nozzle 50 extending outside the seating means and the tip of the nozzle opening 46 (concealed at this point) extending outside the seating means as well as shown in FIG. 3. It will be appreciated that the detachable nozzle 50 and liner 40 are intact when the nozzle is inserted through the rim of opening 31 in the cap 30 to seat the liner within the cap proximate the inflection points 55, 57 and that the nozzle opening 46 is concealed until the separable portion 52 of the nozzle 50 is detached from the liner 40 as shown in FIGS. 2-6. As illustrated in FIG. 5, it is next secured to bottle 20 to form an airtight dispensing system. As user U squeezes bottle body 42, the internal pressure increases and dispensing (or evacuation) of contents C begins (FIG. 7). Air then enters through umbrella valve 24, thus literally replacing the voided contents and neutralizing the pressure in space S between liner 40 and the inside of bottle body 42. As illustrated in the sequence in FIG. 9, the more the contents are dispensed, the more liner 40 collapses, and the more air enters through umbrella valve 24 increasing the volume of air in space S to replace the internal volume displaced by the dispensed contents. This simple dispensing operation incorporates the same natural tendencies of users in the food service industry. Once the dispensing is completed, the user may then elect to store the dispenser in an upside down disposition as illustrated in FIG. 8.

Figure 9:
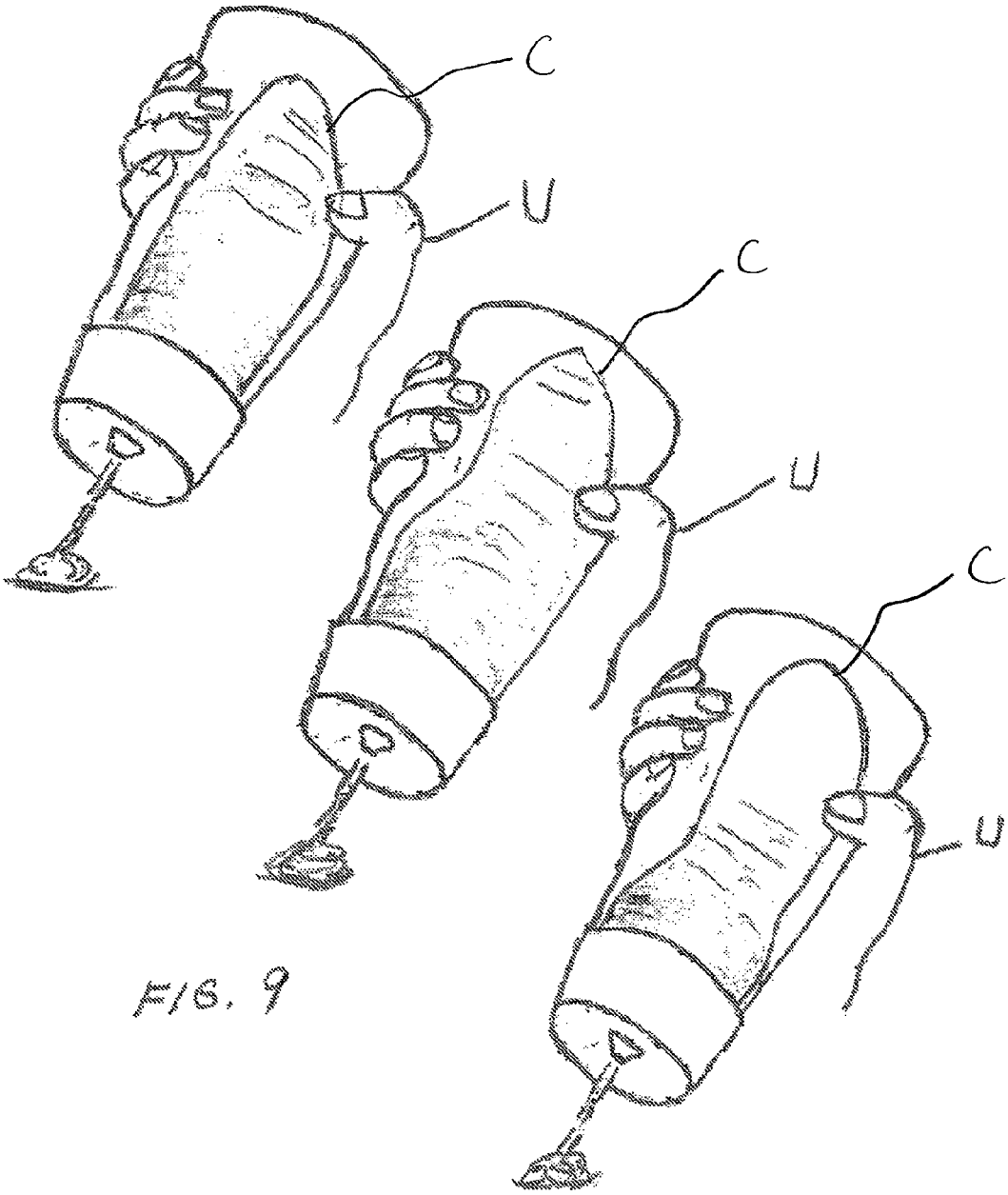
FIG. 9 is a perspective view preferred embodiment being dispensed with the contents diminishing.

In FIG. 9, liner 40 is illustrated in an increasingly "partially dispensed disposition". It begins with perhaps about 20% of the sauce already evacuated, then 50%, then about 80%. During the dispensing operation the bag collapses from its closed end towards the open end. This occurs primarily due to two factors. First, gravity urges the contents to fall below to the open dispensing end 46, plus the tapered closed end tends to collapse first as it is the point of least resistance on liner body 42. In other words, the pressure inside bottle 20 that is applied during dispensing, will force the collapse of liner 40 at its point of least resistance. Once this collapsing process begins, it will continue until the substantially all of the contents are evacuated. This is an important feature of the dispensing system of the preferred embodiment as it substantially reduces waste. It is a common problem throughout the trades and in homes that the last contents in a bottle or container are the most difficult to dispense.

As illustrated the liners of preferred embodiment disclosed herein may be tubular, oval, rectangular and so on when filled, yet; may start out in a layflat disposition, folded, sheeting for form, fill and seal, three dimensionally thermoformed and so on. It is by no means intended to be restricted only to the configuration shown herein, but may be formed in an endless number of configurations to produce the desired result. Likewise, it may have a flat, horizontal bottom, or rounded as illustrated. It may be made from a single layer film, multi-layer laminant, and so on. It may or may not include a fitment for a nozzle, which fitment may be openable in any number of methodologies. The means of maintaining the airtight environments inside the dispenser may be with the use of a seating means, a one-way valve, such as a duck bill, a force fit gasket, and so on and so on. The only provision being that this means sufficiently cuts off the air supply and prevents it from returning back inside the liner. The design of the container is also such that it will have at least one primary point of least resistance in order to initiate and effect collapsing of the liner.

C. Variations in Liners and Dispensers

Figure 10:
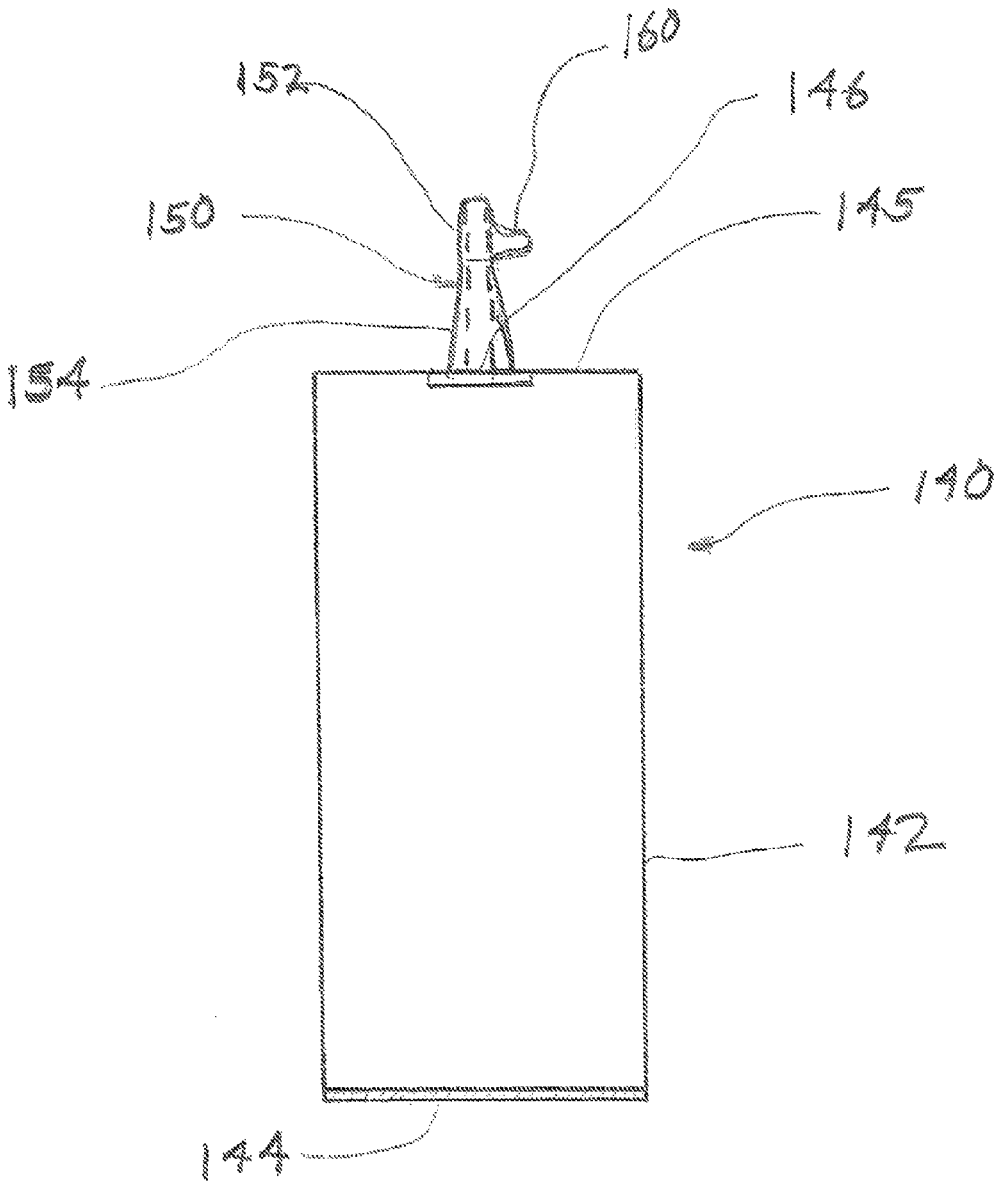
FIG. 10 is a variation of the preferred embodiment with a fitment attached for use as a nozzle.

In FIG. 10 liner 140 of the preferred embodiment has a disposable fitment 150 instead of a nozzle, which has been permanently attached to liner 140. Like liner 40 previously discussed, liner 140 has a body 142, a closed end 144 (defined by a sealed line), a top 145, which in this case is defined by a fold line, and an open portion 146 in the region of top 145. Nozzle 150 has an upper openable tip 152, a base 154, and is securely attached liner top 145 proximate to open portion 146. With a plastic liner of the preferred embodiment, this secure attachment would typically be by heat sealing or the use of an adhesive, or perhaps both. As illustrated with the use of fitment 150, it may be attached in any location that serves the purpose of forming a three dimensional container for the purposes described herein. For example, it may be attached along a fold line, a sealed line, or in a panel along the upper portion. Also, with the use of fitment 150, it would be used with the same methods to form an airtight dispenser as previously described. The container does not have to be made from a layflat configuration, but may be made from a pre-formed three-dimension form, which may initially be in a layflat, folded, nested disposition and so on. For example a seating means, such as a gasket or a one-way duckbill valve, and so on. If a duckbill valve is used, then nozzle 150 would tend to be in a flattened disposition to accommodate the flattened shape of the duckbill valve.

A suitable means of opening the nozzles may be a simple pull tab system 160 that tears horizontally and releases openable tip 152 from base 154, much like those used on tops of many containers to protect the contents, such as pills. In this case it simply separates tip 152 from base 154. Upon pulling tab 160, the horizontal tear continues around the nozzle until the entire end tip is removed. Regardless of the opening means of nozzle 150, the dispensing operation using fitments is substantially the same as previously described herein, with substantially the same results.

Fitments may be made from plastics such as low density polyethylene, or some of the newer designer resins that will allow the fitments to be collapsible, much like that of a flexible but somewhat rigid duck bill valve. The base 154 of fitment 150 may include its own seating means instead of having it on the cap itself. In other words, formed into base 154 may be a flared portion, that serves the same purposed as a gasket, which flared portion seats itself into the cap, serving the same purpose as seating means 34 in FIGS. 2, 3, 4 and so on. This eliminates a single step in the manufacturing process.

Figure 11:
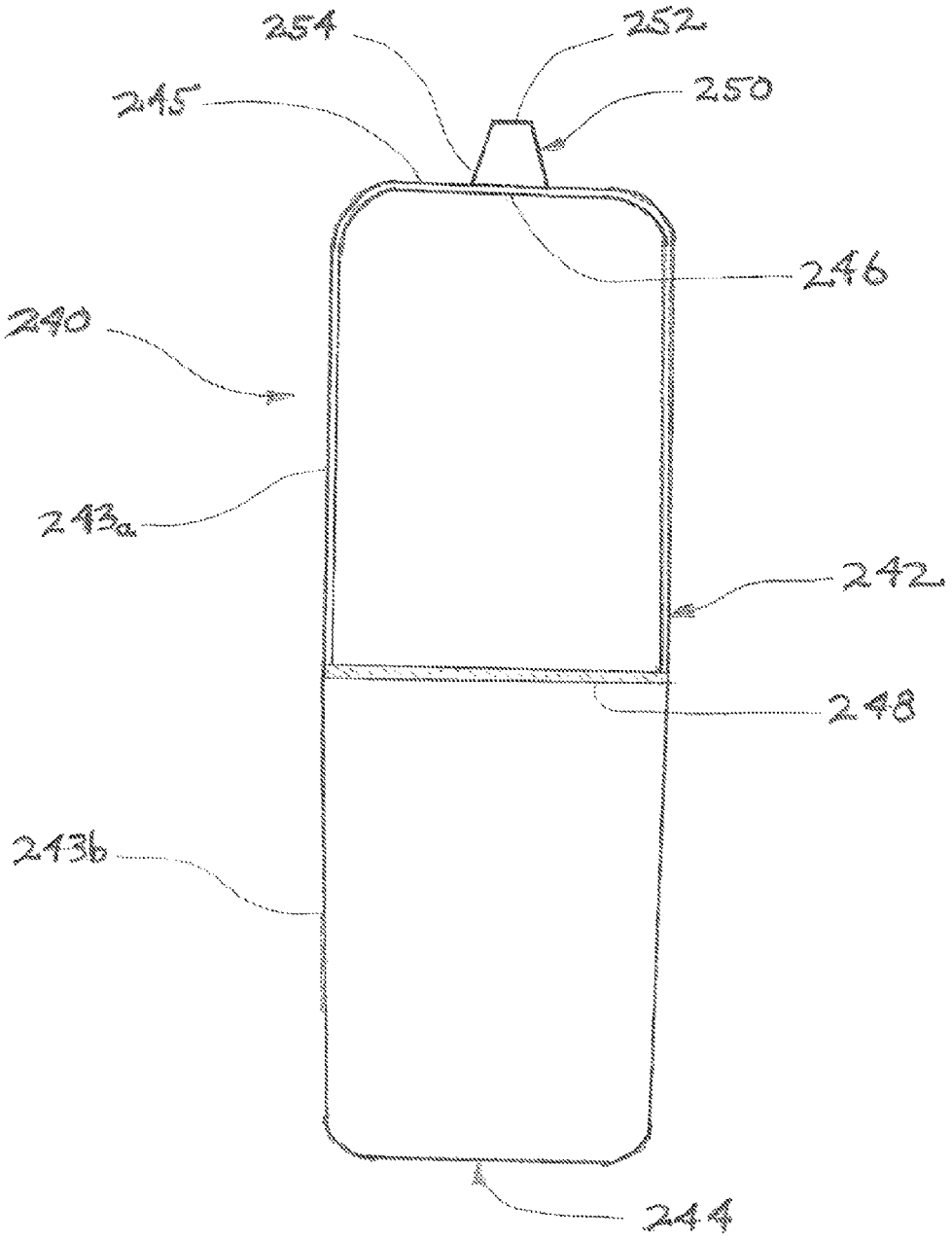
FIG. 11 is another variation of the preferred embodiment with a fitment attached for use as a nozzle.

In FIG. 11 liner 240 of the preferred embodiment has a disposable fitment 250 instead of a nozzle, which has been permanently attached to liner 240. Like liners 40 and 140 previously discussed, liner 240 has a body 242, a closed end 244, a top 245, and an open portion 246 in the region of top 245. However, in this version of the preferred embodiment, body 242 consists of two components, a top portion 243*a* and a bottom portion 243*b*. Top portion is of a generally thicker, more rigid construction, whereas the bottom portion

243*b* is of a generally thinner, more flexible material. This constructions allows for the thinner, more flexible bottom portion 243*b* to collapse and invert inside rigid top portion 243*a* when contents are being dispensed. As illustrated, rigid top portion 243*a* is permanently attached to flexible bottom portion 243*b* by seal 248. This type of construction may be accomplished by any number of flexible packaging manufacturing processes, but most prominently by that commonly used in the pouch making industry. The primary criteria for the rigidity of the top portion 243*a* is that of being substantial enough to maintain its physical shape when dispensed in a dispenser of the type described herein, all the while allowing the flexible portion 243*b* to collapse and invert inside top portion 243*a*.

Fitment 250 is a one-way valve much like that discussed in our co-pending patent application U.S. 61/520,573 and has an upper openable tip 252, a base 254, and is securely attached to liner top 245 proximate to open end 246. Being a disposable fitment it would typically be secured to a liner of the preferred embodiment by heat sealing or the use of an adhesive, or perhaps both. It may even be formed as an inherent part of the upper portion 243*a*. As illustrated fitment 250 may be attached in any location that serves the purpose of forming a three dimensional container for the purposes described herein. For example, it may be attached along a fold line, a sealed line, or even a separate panel along the top part of upper portion. Also, with the use of fitment 250, it would be used with the same methods to form an airtight dispenser as previously described. The container does not have to be made from a layflat configuration, but may be made from a pre-formed three-dimension form, which may initially be in a layflat, folded, nested disposition and so on. These processes are known to varying degrees in the field of flexible plastics manufacturing and pouch making and may including gusseting, affixing of panels, and so on.

As previously described the material and construction of the liner in FIG. 11 and its one-way valve (or nozzle as the case may be), it has substantially the same degree of flexibility of use of materials suitable for the application, size and shape of liners and dispensers, and adaptable to methods of use and filling methods. The formation of the one-way valve or nozzle may be in any number of forms and may also include spray top attachments, pump systems and so on. Likewise and attachable, reusable valve or nozzle may be used instead of a disposable one.

D. Methods of Filling

The preferred embodiment may be filled in any number of commercially available systems, for example, FFS, or pouch filling methodologies and then may be packaged in a carton (container) suitable for storing bulk liners, for example 24 units per carton. By using existing technologies, the cost of modifying existing equipment or purchasing new equipment is an inexpensive proposition. By packaging say 24 liners per carton, a restaurant may, for example, purchase an entire carton and simply insert a liner into a dispenser "as needed". When the liner is empty, a new one may be inserted in the dispenser and so on. This dramatically eliminates the necessity to trans-fill from a large bulk container into a small squeeze bottle, or to wash out a squeeze bottle (dispenser) after each use. Since dispensers of the preferred embodiment do not come into contact with the contents, washing them out may be once a day, a week, or even over longer intervals.

E. Other Variations

The spirit of the preferred embodiment provides a breadth of scope that includes all methods of making and using it and processes of dispensing and filling. Any variation on the theme and methodology of accomplishing the same that are not described herein would be considered under the scope of the preferred embodiment.

What is claimed is:

1. A dispensing system comprising:

a squeezable dispenser bottle with a closed bottom end and an open top end defining a liner receiving opening and a sidewall therebetween constructed to compress inwardly when squeezed by hand;

a dispenser cap constructed to releasably engage the top end of the bottle, the dispenser cap further including a nozzle aperture defining a flexible, peripheral sealing rim; and an elongated disposable liner having a closed bottom end and a peripheral sidewall cooperating to define a content receiving section pre-filled with a volume of flowable contents, the liner further including a pair of opposing transition shoulders that turn inwardly from the peripheral sidewall of the liner and a separable component projecting upwardly from the transition shoulders and concealing a liner opening leading into the content receiving section until removed, the separable component having a tip penetrating through the flexible, peripheral sealing rim of the nozzle aperture to seat at least a portion of the liner within the flexible sealing rim of the nozzle aperture coupling the liner to the dispenser cap and suspending the content receiving section within the bottle body with at least a portion of the liner opening projecting out through the nozzle aperture, the separable component being separable from the liner to expose the liner opening with the liner coupled to the dispenser cap wherein hand squeezing of the sidewall of the dispenser bottle in an inverted configuration disgorges at least a portion of the volume of flowable contents out through the liner opening from the content receiving section and wherein releasing the sidewall of the dispenser bottle closes the liner opening inhibiting the flow of the volume of flowable contents out through the liner opening.

2. The system of claim 1 wherein:

the insertion of the tip through the nozzle aperture of the cap coupling the liner to the cap forms an airtight bottle when the cap is engaged with the bottle.

3. The system of claim 1 wherein:

the bottle contains a one-way valve constructed to allow external air to enter into the bottle and replace the volume of flowable contents forced out through the liner opening to maintain the liner in a collapsed configuration once the bottle is squeezed and released by neutralizing the pressure in the space between the bottle and liner.

4. The system of claim 1 wherein:

the closed end of the liner is tapered inwardly to provide a point of least resistance when the bottle is squeezed to drive at least a portion of the volume of flowable contents out through the liner opening as the liner collapses starting at the closed end of the liner.

5. The system of claim 1 wherein:

the flexible, peripheral sealing rim of the nozzle aperture of the cap defines a form-fit gasket.

6. The system of claim 1 wherein:

the separable component includes a pull-tab with a region of separation that exposes the liner opening of the liner when the pull-tab is detached from the liner after the pull tab is inserted through the dispenser cap.

7. The system of claim 1 wherein:

the liner and the separable component are formed as a single piece.

8. The system of claim 1 wherein:

the liner comprises a thermoformed liner made with food-related barriers.

9. The system of claim 1 wherein:

the liner is collapsible, and collapses upon dispensing the volume of contents out through the liner opening.

10. The liner of claim 1 wherein:

the liner opening is flanked by a pair of inwardly tapering, flexible extensions of the liner body through which the volume of flowable contents flow between when the bottle is squeezed and out through the liner opening.

11. The dispensing system of claim 1 wherein:

the separable component is irreplaceable on the liner once detached.

12. A method for dispensing a volume of flowable contents from a hand squeezable dispenser bottle, the method comprising:

providing a dispenser bottle with a pair of opposing sidewalls and an open top end;

providing a cap having a nozzle aperture with a flexible peripheral sealing rim;

providing a pre-filled liner having a volume of flowable contents for substantially filling an interior of the dispenser bottle, the liner having an upwardly projecting extension surrounding an opening sealed off by a separable component with a penetrating tip;

suspending the liner from the cap by inserting the penetrating tip through the flexible peripheral sealing rim to seat the upwardly projecting extension of the liner within the flexible peripheral sealing rim of the nozzle aperture with the opening of the liner disposed outside the flexible peripheral sealing rim;

coupling the cap to the top end of the bottle to suspend the volume of flowable contents within the dispenser bottle and form an airtight seal;

providing at least one valve in the dispenser bottle constructed to maintain the liner in a collapsed state once the liner begins to collapse when the bottle is hand squeezed and released;

exposing the opening of the liner by permanently separating the separable component from the liner;

inverting the airtight dispenser bottle over a surface to receive at least a portion of the volume of flowable contents;

hand squeezing the opposing sidewalls of the airtight dispenser bottle to force out at least a portion of the volume of contents out through the opening of the liner as an internal pressure in the dispenser bottle is increased; and relaxing the sidewalls of the dispenser bottle to allow a volume of external air to enter the bottle through the at least one valve and replace the forced out volume of contents to maintain the liner in a collapsed configuration.

13. A pre-filled disposable liner for use with a squeeze bottle dispenser having a bottle body with an enlarged primary opening and a cap having a flexible nozzle aperture, the liner comprising:

an elongated liner having a closed end and an elongated sidewall projecting inwardly at a shoulder region and transitioning to an upwardly and inwardly tapering upper section terminating in a flexible uppermost end with an opening leading into an interior of the liner with at least a portion of the liner being constructed to fit within and substantially fill the bottle body when placed therein;

a volume of contents disposed within the interior of the liner to define a pre-filled liner containing a volume of viscous material, a volume of fluid, or a volume of gas; and a disposable nozzle sealing off the opening leading into the interior of the liner, the disposable nozzle terminating in a pull tab with a penetrating tip to guide the disposable nozzle through the flexible nozzle aperture of the cap until at least a portion of the flexible uppermost end of the liner is seated within the flexible nozzle aperture of the cap and the opening of the liner is disposed at least partially exterior to the flexible nozzle aperture of the cap, the pull tab further being constructed to separate the disposable nozzle from the liner to expose the opening leading into the interior of the liner through which at least a portion the volume of contents evacuates from the liner through the opening leading into the interior of the liner when the cap is coupled to the liner by the flexible nozzle aperture and also coupled to the bottle body to suspend at least a portion of the liner within the bottle body and the bottle body is inverted and hand squeezed.

14. The liner of claim 13 wherein:

the cap and bottle body form an airtight dispenser when the pull tab is inserted through the cap to seat the flexible uppermost end of the liner in the cap and the cap is secured to the bottle body.

15. The liner of claim 13 wherein:

the liner has a tapered closed end.

16. The liner of claim 13 wherein:

the liner and pull tab are formed as a single piece.

* * * * *